United States Patent [19]

Barbe et al.

[11] 3,973,073

[45] Aug. 3, 1976

[54] BICOMPONENT POLYESTER FILAMENTS AND PROCESS FOR MAKING SAME

[75] Inventors: Gérard Barbe, St. Didier; Robert Habault, Lyon; Jean-Louis Tamet, Besancon, all of France

[73] Assignee: Rhone-Poulenc-Textile, Paris, France

[22] Filed: Mar. 18, 1975

[21] Appl. No.: 559,421

Related U.S. Application Data

[63] Continuation of Ser. No. 356,476, May 2, 1973, abandoned.

[30] Foreign Application Priority Data

May 4, 1972 France ..... 72.16921

[52] U.S. Cl. ..... 428/370; 428/394

[51] Int. Cl.[2] ..... B32B 15/00; D02G 3/00

[58] Field of Search ..... 428/373, 374, 370, 394; 260/75 R

[56] References Cited

UNITED STATES PATENTS 2,895,946 7/1959 Huffman ..... 260/75 R 3,520,770 7/1970 Shima et al. ..... 428/370

3,671,379 6/1972 Evans et al. ..... 428/373 X

*Primary Examiner*—Lorraine T. Kendell

*Attorney, Agent, or Firm*—Murray and Whisenhunt

[57] ABSTRACT

Bicomponent polyester filaments are disclosed, wherein the filaments are made of at least two different, substantially unmixed components, each present in an amount of at least 20% by weight of the total filament, one component being polyethylene terephthalate and the other component being polybutylene terephthalate which has been sparingly crosslinked with trimethylolpropane.

The bicomponent polyester filaments of the present invention have excellent physical properties and especially improved permanency of crimping. The filaments may be used to manufacture woven and knit materials, and are especially useful in the manufacture of hosiery, wherein the resulting hosiery articles have excellent wear properties.

7 Claims, 2 Drawing Figures

BICOMPONENT POLYESTER FILAMENTS AND PROCESS FOR MAKING SAME

Figure 1:
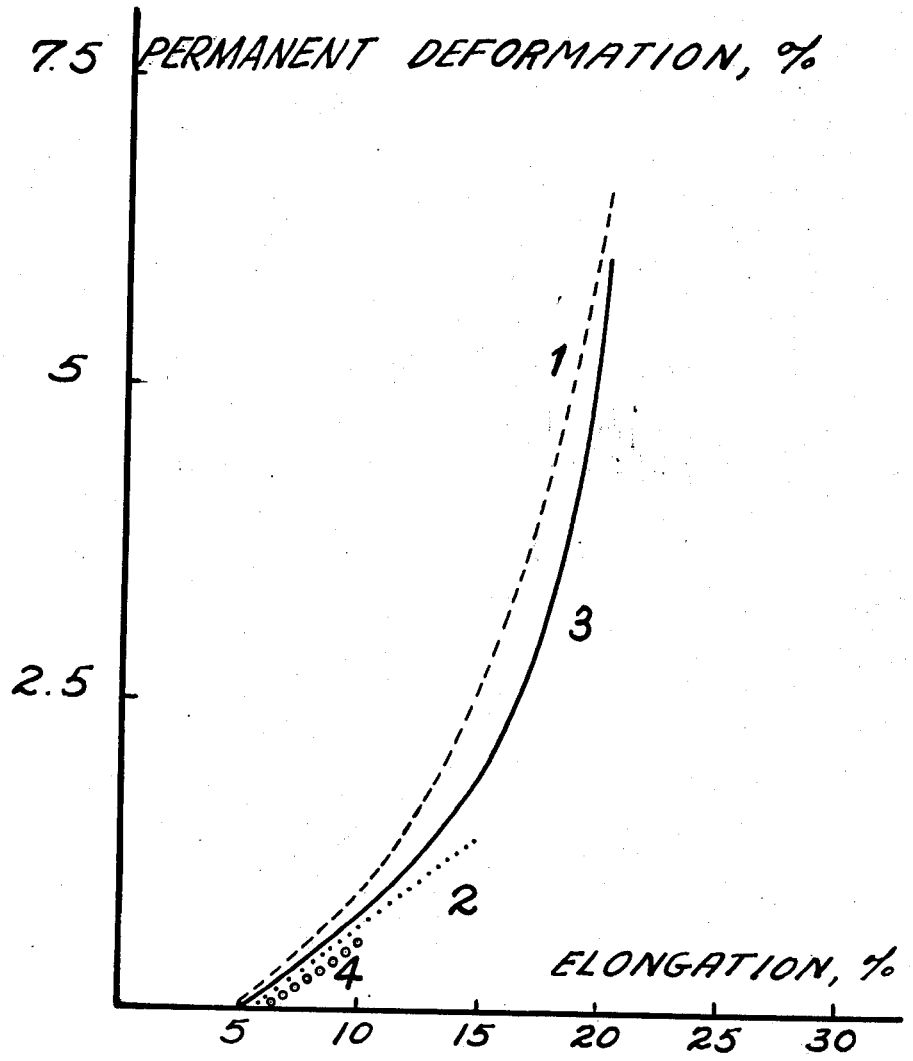

This is a continuation of application Ser. No. 356,476 filed May 2, 1973, and now abandoned.

BACKGROUND OF THE INVENTION

The present invention relates to crimped bicomponent polyester fibers, formed of two different polyesters having different thermal shrinking properties and different mechanical behavior with respect to various mechanical and/or thermal treatments, especially treatments subsequent to shrinking or stretching operations.

Elastic crimped fibers of polymeric materials have already been obtained by mechanical processing, such as assembling two filaments which are twisted in the opposite directions (or torsion twisting), and then fixing the twist and untwisting the resulting multifilament.

Bicomponent fibers have been obtained by extrusion of at least two different polymers, having different shrinking potentials, which may be of substantially the same or quite different nature, through the same spinneret die opening. Such bicomponent fibers have a latent crimping ability which can be developed during subsequent processing steps.

The results obtained by the prior art in the field of polyester filaments made of a single polymer and crimped by conventional processes, such as the use of a heated sharp edge or false twisting, have never been satisfactory, as the crimping and elasticity disappear because of a creep of the material, and especially during those times when the filaments are subjected to tension in the manufacture of finished products, such as woven or knit cloths, or in the process of manufacturing finished goods from such finished products. Polyester polymers are known to have significant plastic flow so that the elasticity of the fibers, even when the fibers are composite fibers, rapidly decreases with fatigue.

The prior art has suggested that a crimped bicomponent fiber be made of a homopolyester and a copolyester made from diacids, at least one diacid being common to the two polymers, and a diol and one or more triols. For instance, U.S. Pat. No. 3,454,460 discloses a composite polyester fiber formed of polymethylene glycol terephthalate, and a copolymer of the polymethylene glycol terephthalate and of a terephthalate of another diol or of a polymethylene glycol isophthalate.

French Pat. No. 1,486,035 describes a composite polyester filament made of polyethylene terephthalate and polyethylene terephthalate crosslinked with trimethylol propane.

French Pat. No. 1,442,768 discloses a composite fiber capable of developing a helical crimp and which is stable to heat and to deformation. Among the components taught by this patent as suitable for the composite fiber are polyethylene terephthalate and polybutylene terephthalate. Such products have a slightly better crimp permanency than other known bicomponent polyester fibers.

The prior art fibers described above, although having elastic properties which are more permanent than those of textured fibers produced by conventional mechanical processes, are still not completely satisfactory for textile uses.

DESCRIPTION OF THE INVENTION

It has now been found that bicomponent polyester fibers having permanent crimp and elasticity, higher than obtainable with any prior art bicomponent polyester fibers, can be produced if one of the components is polyethylene terephthalate and the other component is polybutylene terephthalate sparingly crosslinked with trimethylolpropane. The present invention is directed to such polyester fibers and to the process for making same.

The polymers used in the bicomponent fibers of the present invention are disposed along the length of the fiber. Such fibers are known to the art and are generally designated by the term "bilaminated." The proportion of each of the polymers in the fiber may be adjusted by control of the individual pumps feeding each material to the spinneret die, and each polymer will generally comprise about 20–80% by weight of the final filament. Preferably, however, each polymer in the filament will be present in an amount of about 50% by weight. The cohesion between the two polymers is excellent, and no discontinuity can be discovered by microscopic examination, even using phase contrast and polarized light.

The polyethylene terephthalate preferably has a viscosity value IV, as defined hereinafter, between 450 and 800, and a melted state viscosity VF, as defined hereinafter, between 800 and 2500 poises at 290°C. The sparingly crosslinked polybutylene terephthalate preferably has a viscosity value IV between 1000 and 1500, and a melted state viscosity VF between 3500 and 5500 poises at 260°C. The amount of trimethylolpropane used in the polybutylene terephthalate, which is normally introduced therein during the polycondensation reaction, is generally between 0.20 and 0.60 mole percent, in a relation to the terephthalic acid content of the polybutylene terephthalate, and is most preferably between 0.3 and 0.4 mole percent.

The process for obtaining the bicomponent fibers of the present invention is conventional. For instance, the processes for producing bicomponent fibers used by the prior art patents acknowledged hereinbefore, the disclosure of which are hereby incorporated by reference, may be utilized in the production of the bicomponent fibers of the present invention. In general, the two dry polymers which are used are separately melted, either in melting apparatus or in extruder barrels, at temperatures between 275° and 300°C. for the polyethylene terephthalate and between 255° and 265°C. for the crosslinked polybutylene terephthalate. The polymers are separately proportioned by metering pumps into two component spinneret assemblies. The two polymers are extruded together through the same spinneret die, the wall of which is generally brought to a temperature between 260° and 285°C. The spinneret dies normally range in diameter between about 0.20 and 0.65 mm. The number of spineret dies is unlimited, which permits spinneret manufacture of a very great range of fiber assemblies. The spinning speed is normally between about 300 and 1700 meters per minute, with the extruded fiber being conveniently cooled by an air current.

The filament is then generally stretched at a ratio between about 2× and 4×, according to conventional processes, such as on heated fingers or on heated rolls, at speeds which vary, for instance, from 200 to 3000 meters per minute.

The resulting filament thus obtained has a helical crimp, and the two components of the filaments lie side by side in the filament. The helical yarn crimp is very regular and, contrary to previous polyester bicomponent filaments, does not have any plastic flow. The filament of the present invention has good resistance against the effect of mechanical actions, such as charging and discharging operations, or stretching operations followed by thermal treatment, such as dry or wet fixings.

It is remarkable that the crimping of the present filaments is obtained without a separate crimp developing step.

The fibers of the present invention exhibit characteristics which are decidedly better than the known bicomponent polyester fibers. In particular, the durability of the crimp and the elasticity of the crimped fibers are far superior to the known polyester fibers.

The characteristics of the crimp may be modified, as known to those in the art, by varying the stretching conditions and also by varying subsequent treatment such as overstretching, thermal fixation under tension or in the relaxed state, and boiling water treatment while in the relaxed state.

The permanent filaments of the present invention can be utilized in the manufacture of fabrics, either woven or knit, rugs and the like, but are particularly useful in the field of hosiery, wherein the resulting hosiery products have excellent wear properties.

EXAMPLES OF THE INVENTION

The invention will be understood more clearly with reference to the following examples, which are presented to illustrate, but not to limit, the invention.

In the following examples, the viscosity factor IV was determined from the viscosity of a solution of 1% weight/volume of the polymer in orthochlorophenol, measured at 25°C., according to the formula set forth below, wherein the concentration is expressed in grams per 100 ml:

$$\frac{\text{specific viscosity} \times 1000}{\text{concentration}}$$

The viscosity VF is the viscosity of the melted polymer, expressed in poises, as determined by the Davenport extrusion plastometer.

The extensibility $E$ is expressed by the formula:

$$E = \frac{L - l}{l} \times 100 \quad ,$$

in which $L$ represents the length of the uncrimped fiber under a tension of 225 mg/dtex and $l$ represents the length of the crimped fiber without tension.

Starting with the elongation-force curve established for the interval of $l$ to $L$, *half-uncrimping forces and the half-recrimping forces can be read from the ordinated for the corresponding point of E%/2* on the abscissa.

The frequency of crimping is expressed in the number of half-undulations or half-crimps per centimeter of uncrimped fiber.

The permanet crimping curve is established as follows:

The crimped yarn is subjected to deformations (elongation) beyond the limit of extensibility.

The deformation is produced according to successive cycles, the yarn being brought back to its initial length at the end of each cycle.

The permanent deformation versus the initial length, at the beginning of each cycle, represents the permanent deformation due to the previous cycle; this value is referred to the initial length.

The elongation rate is equal to 10% of the initial length of the crimped sample per minute, and the cycles succeed one another without a rest interval until sample rupture.

Figure 2:
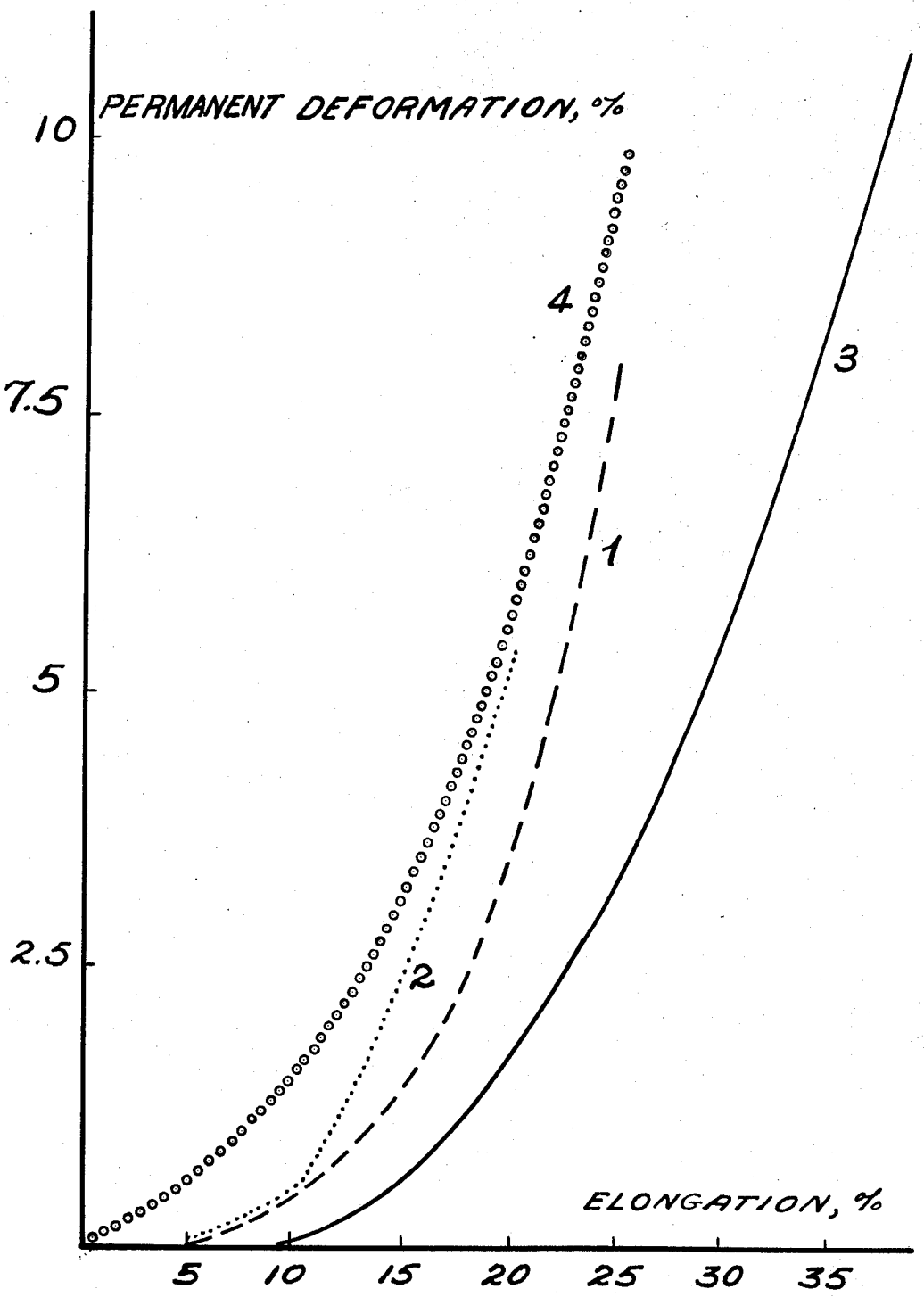

On the curves of FIGS. 1 and 2, the divergences up to 1% are not significant.

In all the examples, the measures are made on yarns which have been conditioned for 24 hours at 65% RH and 22°C.

EXAMPLE 1

In conventional apparatus for spinning bicomponent fibers with polymer fusion, polyethylene terephthalate ($IV = 770$, $VF = 2400$ at a temperature of 290°C.) is melted at 300°C, and polybutylene terephthalate, crosslinked with 0.4 mole percent of trimethylolpropane, ($IV = 1200$, $VF = 4900$ poises at a temperature of 260°C) was melted at 256°C. The two melted polymers pass through a transfer container at 285°C. and then through a spinneret having 32 die openings, the diameter of each being 0.34 mm. The spinning speed was 1250 meters per minute, with the resulting fibers, containing about 50% by weight of each component, being stretched on a cylinder at 85°C., and then passed across a plate maintained at 170°C. and wound up at a speed of 630 meters per minute. The stretching factor of the fibers was 2.81.

For comparative purposes, another bicomponent fiber was produced, using the same conditions except that the polybutylene terephthalate was not crosslinked (contained no trimethylolpropane).

The characteristics of the two fibers produced according to this example, measured both before and after boiling in an unrestrained state for 5 minutes in water after progressive elevation of the water temperature, was as follows:

Table I

| Characteristics | Fiber Not Treated In Boiling Water | | Fiber Treated In Boiling Water | |
|---|---|---|---|---|
| | Cross-Linked | Not Cross-Linked | Cross-Linked | Not Cross-Linked |
| Count, dtex | 79.3 | 8.3 | — | — |
| Tenacity, g/tex | 32.9 | 32.8 | — | — |
| Elongation, % | 9.3 | 7.3 | — | — |
| ½Uncrimping Force mg/tex | 4.03 | 0 | 18.9 | 3.8 |
| ½Recrimping Force mg/tex | 13.8 | 0 | 14.3 | 3.2 |
| Extensibility, % | 167 | 0 | 227.1 | 56.1 |

Table I-continued

| Characteristics | Fiber Not Treated In Boiling Water | | Fiber Treated In Boiling Water | |
|---|---|---|---|---|
| | Cross-Linked | Not Cross-Linked | Cross-Linked | Not Cross-Linked |
| Frequency of ½ Crimping, crimp/cm | 5.14 | 2.10 | 10.04 | 5.05 |
| Permanent deformation, % (Shown in FIG. 1) | | | Curve 1 | Curve 2 |

The values set forth in Table I above clearly illustrate the overall superiority of the bicomponent fiber made with the crosslinked polybutylene terephthalate. It will be noted that the boiling water treatment significantly improves the amount of crimping of the fibers of the present invention. It is, however, not necessary to treat the fibers in boiling water to obtain a crimped yarn, while it is absolutely essential to subject a yarn based upon uncrosslinked polymer to the water treatment in order to obtain an acceptable amount of crimp. It can also been noted that the fiber of curve 2 has broken for 15% elongation.

Besides, the comparison between curves 1 and 2 shows that permanent deformations of approximatively the same values are obtained, taking into account test errors, while the deformations given to the yarn are much more important on the yarn produced with the crosslinked polybutylene terephthalate.

(227% plus elongation % instead of 56% plus elongation %).

The apparatus used in this example is described in greater detail in U.S. Pat. No. 2,386,173 the disclosure of which is hereby incorporated by reference.

EXAMPLE 2

The process and apparatus described in Example 1 were used to produce bicomponent filaments of 75 dtex, 32 filaments, made up of 50% by weight of polyethylene terephthalate ($IV = 770$, $VF = 2400$ poises at 290°C.) and 50% by weight of polybutylene terephthalate. Two different polybutylene terephthalates were used, one crosslinked with 0.4 mole percent of trimethylolpropane ($IV = 1200$, $VF = 4900$ poises at 260°C.), and one polybutylene terephthalate which was not crosslinked ($IV = 1105$, $VF = 4200$ poises at 260°C.). Two sets of filaments were produced and, after stretching, were subjected to relaxation at 120°C. in a humid atmosphere. The windup speed after the relaxation step was 300 meters per minute for the crosslinked bicomponent filament and 200 meters per minute for the non-crosslinked bicomponent filament.

The different speeds were chosen to allow the same rate of relaxation to be obtained for the two filaments in question. It will be readily appreciated that the ordinate rewinding speed for the crosslinked bicomponent filament is an important advantage over the non-crosslinked bicomponent filament.

Table II below sets forth the characteristics measured for the two filaments, before and after treatment in boiling water, for 5 minutes in a free state:

Table II

| Characteristics | Fiber Not Treated In Boiling Water | | Fiber Treated In Boiling Water | |
|---|---|---|---|---|
| | Cross-Linked | Not Cross-Linked | Cross-Linked | Not Cross-Linked |
| Count, dtex | 80.6 | 79.4 | — | — |
| Tenacity, g/tex | 35.6 | 31.5 | — | — |
| Elongation, % | 15.2 | 10.8 | — | — |
| ½Uncrimping Force, mg/tex | 10.7 | 0 | 21.3 | 2.95 |
| ½Recrimping Force, mg/tex | 9.6 | 0 | 16.8 | 2.3 |
| Extensibility, % | 43.8 | 0 | 224.6 | 52.1 |
| Frequency of ½ Crimping, crimp/cm | 9.75 | 3.55 | 9.9 | 3.81 |
| Permanent deformation; % (Shown in FIG. 1) | | | Curve 3 | Curve 4 |

It will be noted that all the characteristics of the filament containing the crosslinked polybutylene terephthalate are noticably higher than those of the control filament. The boiling water treatment, while improving the qualities of the resulting filament, is not essential to obtaining an acceptable crimped filament from the filaments containing the crosslinked polybutylene terephthalate. It can be also noted that the fiber of curve 4 has broken for 10% elongation.

EXAMPLE 3

Using the process and apparatus described in Example 2, bicomponent filaments of 165 dtex, 32 filaments were manufactured. (They contain 50% of each component) The characteristics of these filaments were determined, both for the relaxed and non-relaxed state, with some of the filaments having been treated in a relaxed condition in boiling water for 5 minutes, then air dried and conditioned for 24 hours at 65% RH and 22°C. The filaments were compared to bicomponent control filaments made of polyethylene terephthalate/non-crosslinked polybutylene terephthalate, with the results set forth in Table III below:

TABLE III

| Characteristics | Yarn Not Relaxed, Not Treated In Boiling Water | | Yarn Not Relaxed, Treated In Boiling Water | | Yarn Relaxed, Not Treated In Boiling Water | | Yarn Relaxed, Treated In Boiling Water | | False Twist Yarn (Control) | |
|---|---|---|---|---|---|---|---|---|---|---|
| | Cross-Linked | Not Cross-Linked | Cross-Linked | Not Cross-Linked | Cross-Linked | Not Cross-Linked | Cross-Linked | Not Cross-Linked | Not Treated In Boiling Water | Treated In Boiling Water |
| Count, dtex | 178.0 | 169.0 | — | — | 184 | 171 | — | — | 172 | — |
| Tenacity, g/tex | 33.3 | 33.1 | — | — | 34.2 | 35.3 | — | — | 38 | — |
| Elongation, % | 19.5 | 13.6 | — | — | 26.6 | 20.5 | — | — | 17.3 | — |
| ½ Uncrimping, mg/tex Force | 6.45 | 3.5 | 29.3 | 8.0 | 13.9 | 5.5 | 32.6 | 12.1 | 10.3 | 63.6 |
| ½ Recrimping mg/tex Force | 6.3 | 3.3 | 19.9 | 7.75 | 12 | 5.3 | 24.3 | 9.9 | 1.62 | 17.6 |
| Extensibility, % | 78.0 | 44.9 | 26.6 | 98.0 | 26.2 | 23.3 | 235.6 | 88.4 | 23.9 | 236.1 |
| Frequency of ½ Crimping crimp/cm | 6.20 | 3.08 | 8.68 | 5.40 | 5.21 | 4.32 | 8.85 | 6.25 | 9.46 | 12.38 |
| Permanent deformation, (Shown in FIG. 2) | | | Curve 1 | Curve 2 | | | Curve 3 | Curve 4 | | |

All of the characteristics of the bicomponent fibers of the present invention, using the crosslinked polybutylene terephthalate polymer as one of the fiber components, shows clear superiority over the control filaments containing non-crosslinked polybutylene terephthalate, especially with regard to elasticity, crimping, and durability. The curves of FIG. 2 show a significant improvement in residual elongation for the bicomponent filaments containing the crosslinked polybutylene terephthalate.

The comparison with the physical characteristics of a false twist filament of the same title indicates that they are the same order of magnitude.

EXAMPLE 4

Bicomponent filaments, according to the present invention, containing 50% of each component, were produced by the process and apparatus of Example 1, with stretching then accomplished on cylinders at 130°C. at a speed of 600 meters per minute, with the stretching ratio of 3×. The filaments were then fixed by passage over a plate maintained at 110°C., and certain of the filaments were relaxed at a temperature of 120°C. using a rewinding speed of 200 meters per minute.

Table IV below presents the elasticity characteristics for the fibers at different stages of the process mentioned above, in comparison with corresponding control fibers made using a non-crosslinked polybutylene terephthalate. All of the results set forth in Table IV below indicate the superior characteristics of the bicomponent filaments of the present invention.

What is claimed is:

1. Helically crimped bicomponent polyester filaments of improved elasticity and substantially permanent crimping, said filaments comprising at least 20% by weight of two different, substantially unmixed components in a side-by-side assembly along the length of said filaments, one component being polyethylene terephthalate and the other component being sparingly crosslinked polybutylene terephthalate having at least 0.20 mole percent of crosslinking agent, based on the terephthalic acid content of the polybutylene terephthalate, wherein the sparingly crosslinked polybutylene terephthalate has a viscosity value IV of about 1000 of about 1500.

2. Product of claim 1 wherein the polybutylene terephthalate contains about 0.20 to about 0.60 mole % of trimethylolpropane, based on the terephthalic acid content of the polybutylene terephthalate.

3. Product of claim 1 wherein the polyethylene terephthalate has a melted state viscosity VF of about 800 to about 2500 poises at 290°C.

4. The product of claim 3 wherein the polyethylene terephthalate has a viscosity value IV of about 450 to about 800.

5. Product of claim 1 wherein the sparingly crosslinked polybutylene terephthalate has a melted state viscosity VF of about 3500 to about 5500 poises at 260°C.

6. The product of claim 1, wherein the polybutylene terephthalate contains about 0.3 to 0.4 mole percent of trimethylolpropane.

7. The product of claim 1 wherein each component of the filament is present in an amount of about 50% by weight.

* * * * *

TABLE IV

| CHARACTERISTICS | YARN NOT FIXED | | YARN FIXED | | YARN RELAXED | |
|---|---|---|---|---|---|---|
| | Cross-Linked | Not Cross-Linked | Cross-Linked | Not Cross-Linked | Cross-Linked | Not Cross-Linked |
| Yarn Not Treated in Boiling Water | | | | | | |
| ½ Uncrimping, mg/tex Force | 21.1 | 10 | 24.6 | 7.6 | 21.5 | 11.6 |
| ½ Recrimping, mg/tex Force | 15.1 | 8.4 | 17.3 | 6.2 | 17 | 9.3 |
| Extensibility, % | 323 | 202 | 311 | 199 | 54.2 | 53.5 |
| Yarn Treated in Boiling Water | | | | | | |
| ½ Uncrimping, mg/tex Force | 52.9 | 37.4 | 54.8 | 33.6 | 61.7 | 49.3 |
| ½ Recrimping, mg/tex Force | 30.5 | 21.8 | 32.1 | 20 | 37.7 | 28.8 |
| Extensibility, % | 273 | 247 | 266 | 235 | 236 | 202 |